United States Patent [19]

Takeda

[11] Patent Number: 4,521,459

[45] Date of Patent: Jun. 4, 1985

[54] COATING METHOD AND APPARATUS

[75] Inventor: Hideo Takeda, Kanagawa, Japan

[73] Assignee: Fuji Photo Film Co., Ltd., Kanagawa, Japan

[21] Appl. No.: 495,929

[22] Filed: May 19, 1983

[30] Foreign Application Priority Data

May 19, 1982 [JP] Japan ..... 57-83236

[51] Int. Cl.[3] ..... B05D 3/12

[52] U.S. Cl. ..... 427/359; 118/118; 118/119; 118/206; 118/410; 118/414; 427/371; 427/434.3; 427/434.4

[58] Field of Search ..... 427/359, 434.3, 371, 427/434.4; 118/206, 414, 118, 119, 410

[56] References Cited

U.S. PATENT DOCUMENTS 2,285,041 6/1942 Mayer et al. ..... 118/118

FOREIGN PATENT DOCUMENTS 1964908 8/1970 Fed. Rep. of Germany ..... 118/414
2046138 11/1980 United Kingdom ..... 118/414

*Primary Examiner*—Norman Morgenstern
*Assistant Examiner*—Janyce A. Bell
*Attorney, Agent, or Firm*—Sughrue, Mion, Zinn, Macpeak & Seas

[57] ABSTRACT

In a coating method, a coating section is arranged immediately before a coil bar while a smoother is disposed immediately after the coil bar, immediately after a coating solution is applied to a web which is run continuously a surplus of coating solution is scraped off and the web is subjected to smoothing by the smoother directly without undergoing a gaseous phase.

10 Claims, 3 Drawing Figures

COATING METHOD AND APPARATUS

BACKGROUND OF THE INVENTION

1. Field of the Invention

This invention relates to a method of applying a coating solution to a web which is continuously run and to apparatus for practicing the method, more particularly, to a coating method and a coating apparatus in which the coated film is effectively smoothed.

2. Description of the Prior Art

The term "web" as used herein is not limited and is intended to mean a relatively long, flexible, belt-shaped support such as: a plastic film of cellulose triacetate, polyamide, polyimide, polycarbonate, polyethylene terephthalate or polyvinyl chloride; paper; synthetic paper; a metal foil or aluminum or copper; a sheet of glass or ceramic and the like.

The term "coating solution" is not limited and is intended to mean a variety of coating solutions different in composition depending on the purpose of use. Examples of "coating solutions" include coating solutions for forming a photosensitive emulsion layer, a base layer, a protective layer and a back layer as are conventionally used in photographic photosensitive materials; coating solutions for forming a magnetic layer, a base layer, a wetting layer, a protective layer and a back layer as conventionally used in magnetic recording mediums; and coating solutions for forming an adhesive layer, a coloring layer, a rust-proofing layer, etc. Such coating solutions are typically made up of essential components, a binder, and, if desired or necessary, water or an organic solvent or can be a dispersion containing various additives.

In order to form a coated film on the above-described webs to a desired thickness, the following methods are not extensively employed: a dip, reverse roll, gravure roll, extrusion hopper or slide hopper is used to apply an excess of coating solution to the web which is run continuously. Then, metering means such as an air knife, blade or coil bar (or wire bar) is applied to the coated layer to scrape off surplus coating solution to coat the web with the coating solution to the desired degree or thickness.

In coating a web with a coating solution of high viscosity, such as a magnetic solution for forming a magnetic recording medium, a coil bar has been extensively employed as the metering means because it is simple in structure and can be readily handled as compared to an air knife or blade, and the coated surface is relatively stable in quality.

A conventional coating method using a coil bar is as shown in FIG. 1.

As shown in FIG. 1, web 1 is continuously run in the direction of the arrow and a coating solution 3 is applied to the lower surface of the web 1 to a thickness larger than finally required to form coated film 5 in the liquid state. Surplus coating solution 7 is scraped off by coil bar 6 so that coated film 8 is formed which is regulated by the gap which is defined by the cylindrical wall of the coil bar 6 and the surface of the web 1. If necessary, for instance in the case of forming a magnetic layer, the resulting product is subjected to magnetic field orientation and drying, and is then wound. In FIG. 1, reference numeral 4 designates guide rolls.

Coil bar 6, as shown in FIG. 2, is made up of a core material or a rod member 21 and a wire 22 which is wound in the form of a single coil on the cylindrical wall of the rod member 21 with the turns being in close contact with each another. In general, rod member 21 is a stainless steel, iron or brass rod 1 to 3 mm in diameter and the wire 22 is a stainless steel, trifluoroethylene homopolymer, tetrafluoroethylene homopolymer, or tetrafluoroethylene-hexafluoropropylene copolymer wire 0.04 to 0.05 mm in diameter.

In addition to the above-described coil bar, a small coil bar less than 4 mm in maximum coil radius which was proposed by the present inventors may also be employed (see Japanese Patent Application No. 41060/1981).

Depending on the purpose of use of the product, it is required to smooth the surface of the coated film or coated layer. The coated film or coated layer is smoothed by suitable means after being subjected to metering with the coil bar.

In a conventional coating method as shown in FIG. 1, the web is left in a gaseous circumference during the time interval from the instant that the coating solution is applied to the web until the metering operation is carried out with the coil bar 6 or during the time which from the instant that the metering operation is effected with the coil bar until the smoothing operation is carried out with a smoother (not shown). During such time interval the coated film is not dried or hardened, and, therefore, the metering or smoothing operation is liable to be affected by the viscosity of the coating solution, interfacial tension, and web velocity.

During metering or smoothing, air may go between the metering member and the coated film or the coating material which has been solidified on the metering bar may mix therewith, thus harming the coated surface. This tendency becomes significant as the viscosity of the coating solution increases and coating velocity increases. Therefore, rib-like (streak-like) stripes are formed on the coated surface degrading the smoothness of the surface.

SUMMARY OF THE INVENTION

The present inventor conducted intensive research to eliminate the above drawbacks. As a result, the inventor succeeded in overcoming the above-described drawbacks by eliminating the presence of the gaseous phase between the coating operation and the metering operation and between the metering operation and the smoothing operation, thus reaching the invention.

In a coating method according to the invention, a coating section is provided which also functions to wet a coil bar, i.e., to prevent the coil bar from being dried, and such is provided immediately before the coil bar while a smoother is disposed immediately after the coil bar, so that immediately after a coating solution is applied to the web, which is run continuously, surplus coating solution is scraped off by the coil bar and the web is subjected to smoothing by the smoother directly without undergoing a gaseous phase.

In coating apparatus of the extruder type having a coating solution supplying outlet at its upper portion, a coil bar is disposed at the rear of the supplying outlet and adjacent the supplying outlet and a smoother is arranged at the rear of the coil bar and adjacent the coil bar so that immediately after a coating solution is applied to the web, which is run continuously, surplus coating solution is scraped off by the coil bar and the web is moved to the smoother directly without undergoing a gaseous phase.

DESCRIPTION OF PREFERRED EMBODIMENTS

This invention will be described with reference to the accompanying drawing.

Figure 1:
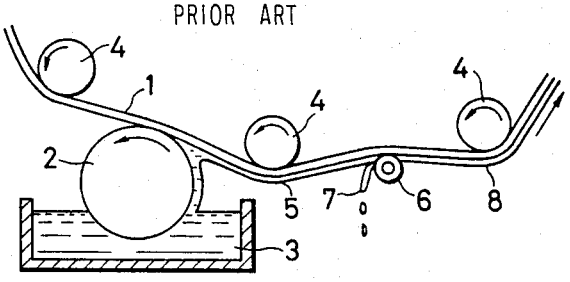
FIG. 1 PRIOR ART
FIG. 1 is an explanatory diagram showing one example of a conventional coating method.
Figure 2:
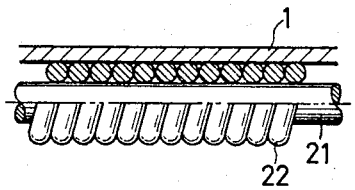
FIG. 2 is a sectional view showing a part of the coil bar which is employed in this invention.
Figure 3:
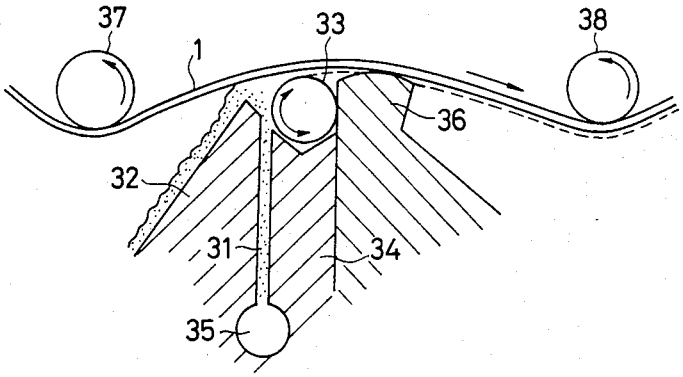
FIG. 3 is an explanatory diagram showing one embodiment of the present invention.

FIG. 3 shows an extruder type coating apparatus which is one embodiment of the invention. The extruder type coating apparatus has a coating solution supplying slot 31 and a coil bar 33 such as described before. The coil bar 33 is arranged in such a manner that it is adjacent the rear of the upper supplying outlet of the extruder type coating apparatus 32 and it is rotatably mounted on a holder 34. A smoother 36 is disposed adjacent the rear of the coil bar. The holder 34 for the coil bar 33 forms a part of the extruder type coating apparatus.

A web 1 such as a film support is continuously run over the coating apparatus. A coating solution 35, for example, for forming a magnetic recording medium is supplied on to the web through sloe 31 so that the lower surface of the web is coated therewith, and the coating solution thus applied is subjected to metering by coil bar 33. Surplus coating solution which has been scraped off drops down the slide surface 32 of the coating apparatus and can be recirculated if desired or necessary. The web on which the coated film is formed to the desired thickness by the metering operation of the coil bar 33 is moved to the smoother 36 where the surface is smoothed.

In the case when the coating operation is carried out as described above, the coating solution supplying slot 31 is immediately before the coil bar 33, and, accordingly, no gaseous phase is encountered during the time interval from the instant that the coating solution is applied until the coating solution is subjected to metering. Futhermore, as smoother 36 is disposed immediately after downstream coil bar 33, the coating solution exists between the coil bar and the smoother, i.e., no gaseous phase exists therebetween. Accordingly, all the drawbacks accompanying conventional coating methods are completely eliminated, and even if a coating solution of high viscosity is applied at high speed, it can be applied uniformly and smoothed with high accuracy.

In FIG. 3, reference numerals 37 and 38 designate guide rolls; however, instead of such guide rolls a web supplying roll and a web winding roll may be employed. The web whose coated film has been smoothed is next dried; however, in the cas of a magnetic layer as described above, the web may be subjected to magnetic field orientation before drying.

In manufacturing the coating apparatus of the invention, different materials may be used for different coating solutions; however, the coating apparatus is generally made of stainless steel. It is preferable that at least the portion of the smoother 36 which is brought into contact with the coated film be made of SUS-304 or SUS 430 (JIS) stainless steel. The smoother 36 may be integral with the coating apparatus if desired. In order to increase wear-resistance characteristic and durability of the smoother 36, it is desirable that the smoother be made of a so-called "ultra hard material" such as GTi-30 or a ceramic, or other materials which have been subjected to a surface-hardening treatment such as nitriding, cementation or hard chromium plating.

In the above-described embodiment, the coil bar 33 is rotated in the same direction as the web travelling direction. However, the rotational direction of the coil bar may be determined according to the speed of web and the physical characteristics of coating solution, such as viscosity.

In the preferred embodiment of the invention, the top surface of the coil bar and the top surface of the smoother are substantially equal in level. Furthermore, it is preferred that the effective length of the smoother (or the length of the upper surface of the smoother in the direction of the running of the web) be about 1 to 30 mm, and the upper surface of the smoother be in the form of an arc (in section) having a radius of 5 to 30 mm or a polygonal surface having at least two surfaces whose internal angle is 160° to 178°.

While the invention has been described mainly with reference to the manufacture of a magnetic recording medium, the invention is not limited thereto or thereby. That is, the technical concept of the invention is applicable to the cases where the above-described various solutions are applied to webs.

What is claimed is:

1. In a coating method which comprises applying a coating solution to a continuously running web, the improvement comprising the steps of; applying a coating solution to said running web from a coating section arranged immediately upstream of a coil bar with a smoother disposed immediately downstream of a coil bar, immediately after the coating solution is applied to the web scraping off surplus coating solution from the web by contact of said coating solution and said coil bar and, immediately smoothing by said smoother directly without having said coating solution undergoing a gaseous phase.

2. The method of claim 1 wherein said coil bar rotates in the same direction as movement of said web.

3. The method of claim 1 further comprising the steps of disposing guide rollers upstream and downstream of said coating section, said guide rolls rotating in the same direction as movement of said web.

4. Apparatus of the extruder type for coating a web with a coating solution comprising: a coating solution supplying extruder outlet at the upper portion of a supply slot, a coil bar disposed at the rear of and adjacent to the supply slot and a smoother arranged at the rear of the coil bar and adjacent to the coil bar, wherein immediately after a coating solution is applied to a web which is continuously run surplus coating solution is scraped off and the web is subjected to smoothing by the smoother directly without undergoing a gaseous phase.

5. The apparatus of claim 4 further comprising a holder for said coil bar, one wall of said holder forming a wall of said supply slot.

6. The apparatus of claim 4 further comprising said extruder outlet facing in the downstream direction and confronting said coil bar.

7. The apparatus of claim 4 comprising a slide surface inclined downward and positioned upstream relative to said extruder outlet to remove excess coating solution.

8. A coating apparatus as claimed in claim 4, wherein the top surface of the coil bar and the top surface of the smoother are substantially equal in level.

9. The apparatus of claim 4 further comprising guide rolls positioned upstream of said extruder outlet and downstream of said smoother to guide said web.

10. In a coating method which comprises applying a coating solution to a continuously running web, the improvement comprising the steps of delivering a coating solution from a coating section having a source and arranged immediately upstream of a coil bar with a smoother disposed immediately downstream of a coil bar, applying said coating solution to said running web through an extension slot, immediately after the coating solution is applied to the web scraping off surplus coating solution from the web by contact of said coating solution and said coil bar, removing said surplus coating solution by transfer to a slide surface upstream of said extrusion slot and, immediately smoothing by said smoother directly without having said coating solution undergoing a gaseous phase.

* * * * *